US005642886A

United States Patent [19]

Yancey, Jr.

[11] Patent Number: 5,642,886

[45] Date of Patent: Jul. 1, 1997

[54] METHOD OF PLAYING A SIMULATED GOLF GAME

[76] Inventor: Arthur M. Yancey, Jr., 609 Thornton Ave., Dalton, Ga. 30722

[21] Appl. No.: 677,414

[22] Filed: Jul. 9, 1996

Related U.S. Application Data

[60] Provisional application Nos. 60/000,986, Jul. 10, 1995, and 60/001,398, Jul. 24, 1995.

[51] Int. Cl.[6] ..... F41J 3/00

[52] U.S. Cl. ..... 273/408; 273/409; 273/317.2

[58] Field of Search ..... 273/245, 259, 273/277, 403, 404, 407, 408, 409, 317.2

[56] References Cited

U.S. PATENT DOCUMENTS

| | | | |
|---|---|---|---|
| D. 291,098 | 7/1987 | O'Connor . | |
| D. 293,455 | 12/1987 | Castro et al. . | |
| D. 329,469 | 9/1992 | Franklin et al. . | |
| 1,076,002 | 10/1913 | Clarke | 273/403 |
| 1,728,630 | 9/1929 | Sanderson | 273/245 |
| 1,928,768 | 10/1933 | Sell . | |
| 2,076,357 | 4/1937 | Tempest | 273/403 |
| 3,424,460 | 1/1969 | Simpson | 273/409 |
| 3,697,073 | 10/1972 | Dooley | 273/408 |
| 3,979,117 | 9/1976 | Worsham . | |
| 4,759,548 | 7/1988 | Chaban | 273/245 |
| 4,949,977 | 8/1990 | Smith | 273/408 |
| 5,020,807 | 6/1991 | Barkley . | |
| 5,197,743 | 3/1993 | Hanson, Jr. . | |
| 5,553,850 | 9/1996 | Savu | 273/408 |

FOREIGN PATENT DOCUMENTS

| | | | |
|---|---|---|---|
| 364932 | 1/1932 | United Kingdom | 273/408 |
| 2127701 | 4/1984 | United Kingdom | 273/409 |
| 2150845 | 7/1985 | United Kingdom | 273/408 |

OTHER PUBLICATIONS

"Super Stars Sports Games", Playthings Catalog, Feb. 1977 issue.

*Primary Examiner*—Sebastiano Passaniti

*Attorney, Agent, or Firm*—David J. Hill

[57] ABSTRACT

A method of playing a simulated golf game, which game may be played using a dart and a dart board having a generally circular playing surface that is adapted to receive the dart. The surface of the dart board includes a plurality of wedge-shaped zones, each of which corresponds to a hole of a golf course, a plurality of annular rings, and a generally circular bullseye located generally at the center thereof. The method includes providing an identifying indicia such as a number for each wedge-shaped zone, assigning a par value to each wedge-shaped zone, assigning a score with respect to par value to the bullseye, and assigning a score with respect to par value to each annular ring. In addition, an ordered sequence for each wedge-shaped zone is assigned so that each wedge-shaped zone may represent a hole of a simulated golf course, and so that the sequence may correspond to a sequence of holes on the simulated golf course representing a round of golf played on such course. As the game is played, each player may, in turn, launch the dart at the dart board for each hole of the simulated golf course and receive a score with respect to par for such hole. The cumulative total of each player's score is deemed to represent such player's score for a round of golf on the simulated golf course. A simulated golf game apparatus which may be employed to play the game is also disclosed.

11 Claims, 2 Drawing Sheets

METHOD OF PLAYING A SIMULATED GOLF GAME

CROSS REFERENCES TO RELATED APPLICATIONS

This application claims the benefit of U.S. Provisional application No. 60/000,986, filed Jul. 10, 1995, and U.S. Provisional application No. 60/001,398, filed Jul. 24, 1995.

FIELD OF THE INVENTION

The present invention relates to dart board games. More specifically, the present invention is a method of playing a simulated golf game using darts and a dart board.

BACKGROUND OF THE INVENTION

Various games employing darts have enjoyed considerable popularity with bar patrons and league players as relaxing, competitive games which can be played while socializing. Recently, there has also been an increase in the popularity of darts as a household game. As a response to this increased popularity, various alternative types of dart boards and different methods of play have been developed.

Thus, for example, U.S. Pat. No. 5,197,743 sets forth a dart board apparatus which is illustrated to simulate a golf course. The back side of the board is in operational connection with a powder chamber piston and a fluid bladder. When a dart impacts a particular area of the board, powder or fluid is emitted to simulate landing in a sand trap or other hazard.

U.S. Pat. No. 3,979,117 teaches a football dart game. The board is configured so that depending on where the dart lands, a different football play is signified.

U.S. Pat. No. 5,020,807 discloses a dart board having a pattern thereon which emulates a nine-hole golf course.

U.S. Design Pat. No. 329,469 teaches a design for a dart board which resembles a baseball field. U.S. Design Pat. Nos. 291,098 and 293,455 both disclose designs for dart boards enabling the game to be played with a football motif.

There remains a need for a method of playing darts based on a golf theme that can be played with a standard dart board, or with a board that resembles or is readily adapted from a standard dart board.

SUMMARY OF THE INVENTION

The present invention is a method of playing a simulated golf game, which includes providing a dart and a dart board having a generally circular playing surface that is adapted to receive the dart. The playing surface is provided with a plurality of wedge-shaped zones, each of which corresponds to a hole of a golf course, a plurality of annular rings, and a generally circular bullseye located generally at the center thereof. The method also includes providing an identifying indicia for each wedge-shaped zone, assigning a par value to each wedge-shaped zone, assigning a score with respect to par value to the bullseye, and assigning a score with respect to par value to each annular ring. In addition, the method includes assigning an ordered sequence for each wedge-shaped zone, so that each wedge-shaped zone may represent a hole of a simulated golf course, and so that the sequence may correspond to a sequence of holes on the simulated golf course representing a round of golf played on such course. As the game is played, each player will, in turn, launch the dart at the dart board for each hole of the simulated golf course and receive a score with respect to par for such hole. The cumulative total of each player's score is deemed to represent such player's score for a round of golf on the simulated golf course.

A dart board that is especially suited for playing the simulated golf game according to the method described and claimed herein is also disclosed. In a preferred embodiment, the method of play is used in conjunction with an electronic dart board to facilitate scoring.

A major feature of the present invention is the golf theme imposed upon the game of darts. Both darts and golf are competitive, social sports which require relatively more control and less strength than other sports. As such, the two sports are often enjoyed by the same individuals. By imposing a golf theme upon a dart game, individuals who normally play darts may increase their level of enjoyment by incorporating the scoring of another sport or game, namely golf. Moreover, the method of play allows individuals to experience the "feel" of golf, when it is otherwise inconvenient or impossible to play golf on a real golf course.

Another major feature of a preferred embodiment of the present invention is that the method of play can be conducted while using a standard, regulation sized dart board without adding to, or altering the structure of the board. This feature enables the game to be played without any increase in the manufacturing cost of the board. Moreover, using a standard regulation-sized board enables play at any location, without the inconvenience of changing, manipulating or altering the dart board.

Still another feature of the present invention, contained in a preferred embodiment, is the use of the method of play with an electronic dart board. By automating the scoring function of the game, the players involved can focus their attention on throwing their darts accurately. Furthermore, using enhanced automation, the number or other indicia of the hole assigned to each wedge-shaped zone of the board can be changed to represent different golf courses. Another embodiment of the invention permits changing the identifying indicia or numbers assigned to each wedge-shaped zone by rotating an annular ring bearing such indicia that is disposed outside of the playing surface of the board.

In addition, the method of play may also be used with a simulated dart board and simulated darts that are electronically created by or on a computer.

Yet another feature of the present invention is the choice of analogies to simulate a golf game using darts and a standard dart board. Each wedge-shaped zone of the board is analogous to a hole; the difficulty of hitting the portion of a particular annular ring within a wedge-shaped zone with a dart is analogous to the difficulty of breaking par; and changing the ordered sequence in which the wedge-shaped zones are targeted by the players is analogous to playing on different golf courses. The choice of these analogies makes the present dart game version more realistic as a simulated golf game.

Other features and advantages will be apparent to those skilled in the art from a careful reading of the Detailed Description of a Preferred Embodiment accompanied by the following drawings. It is not intended, however, that the invention be limited to use with the particular embodiments described or to use in connection with the apparatus illustrated in the drawings. Various changes are contemplated such as would ordinarily occur to one skilled in the art to which the invention relates.

DETAILED DESCRIPTION OF PREFERRED EMBODIMENTS

Figure 1:
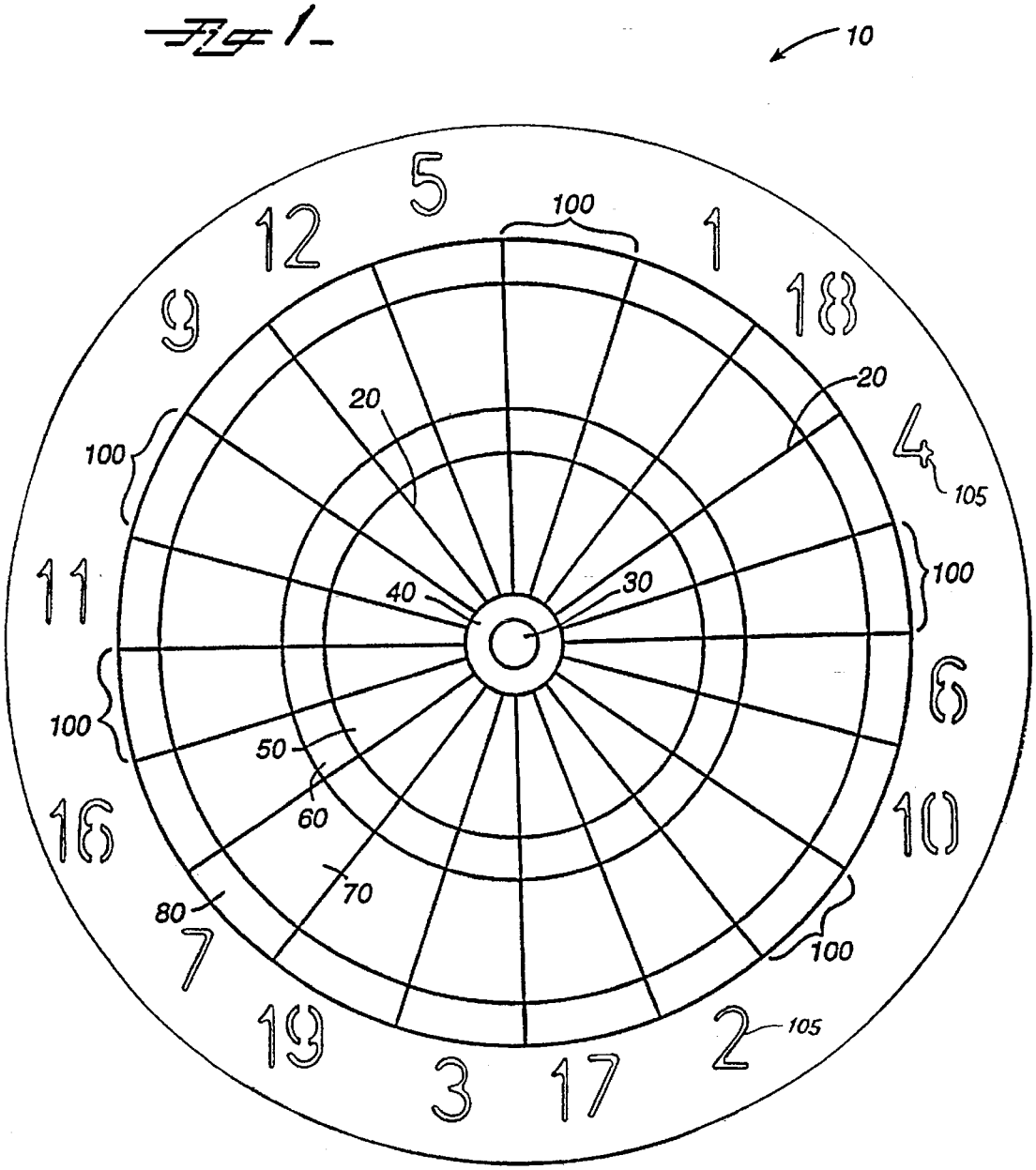
FIG. 1 is a from view of a standard, regulation dart board that may be employed in the practice of the method.

Referring now to FIG. 1, there is shown a standard, regulation dart board, indicated generally by reference numeral 10. Board 10 is circular and made of a material such as horse hair, cork, rubber, paperboard, hog bristles, or a polymeric material. The front surface of board 10 contains wires or thin polymeric strands 20 that define a generally circular bullseye 30 and a plurality of annular rings, including first ring 40, second ring 50, third ring 60, fourth ring 70, and fifth ring 80. Strands 20 further define a plurality of wedge-shaped zones 100, some of which are indicated on FIG. 1. In a regulation dart board, there are twenty wedge-shaped zones or wedges 100, and five rings, although the game described herein may be played on a board having any convenient number of wedge-shaped zones and rings. Each wedge 100 of board 10 is comprised of a portion of second ring 50, third ring 60, fourth ring 70, and fifth ring 80. Each wedge 100 is provided with an identifying indicia 105, such as a number, that is located outside of, but adjacent to the wedge, as shown in FIG. 1, although not all of the indicia for the wedges of FIG. 1 are shown thereon.

Figure 3:
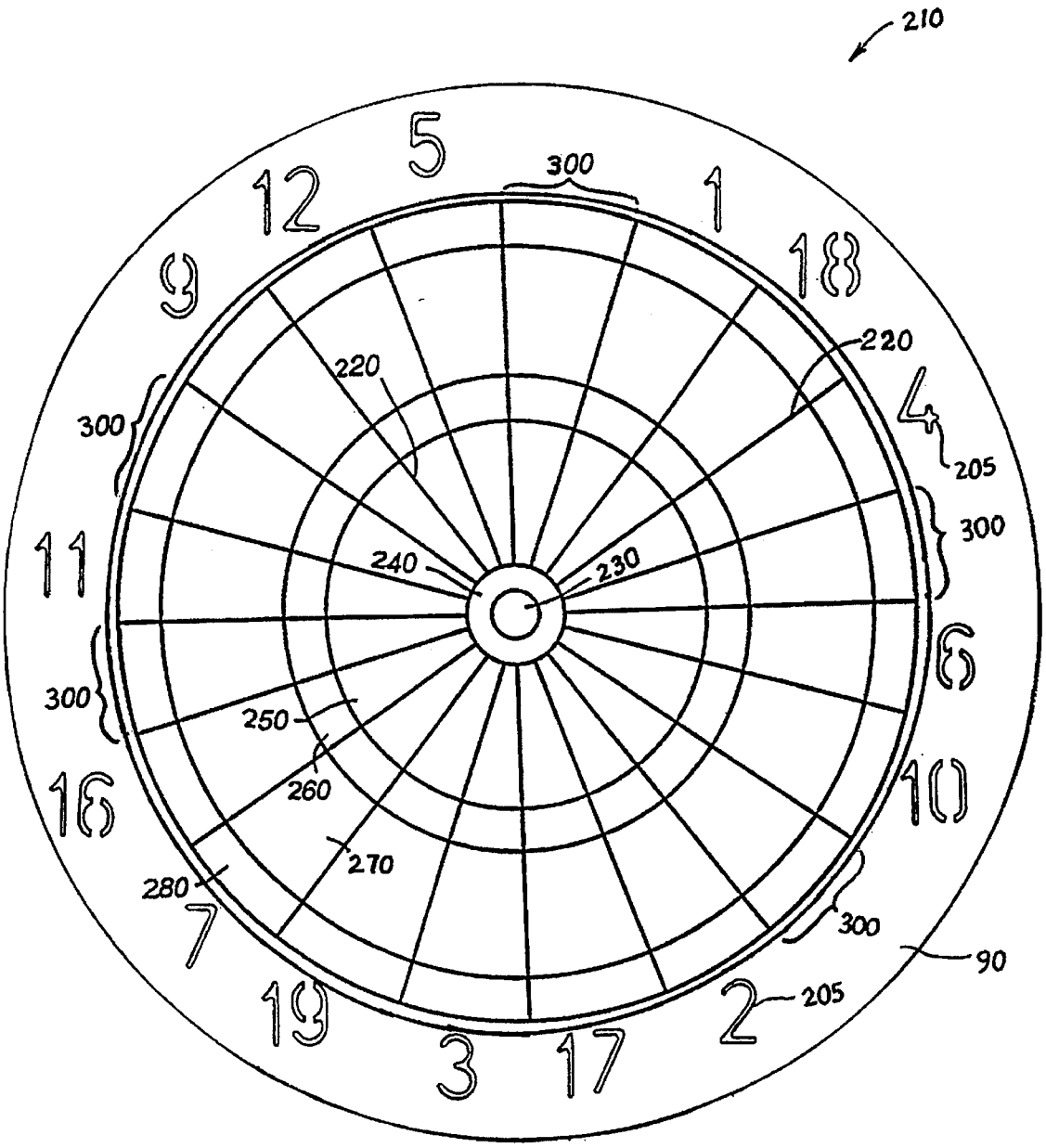
FIG. 3 is a front view of an alternative dart board that may be employed in the practice of the method.

FIG. 3 shows an alternative embodiment of the dart board that may be employed in connection with the invention. As shown therein, board 210 includes wires or polymeric strands 220 that define a generally circular bullseye 230 and a plurality of annular rings, including first ring 240, second ring 250, third ring 260, fourth ring 270 and fifth ring 280. Strands or wires 220 also define a plurality of wedge-shaped zones 300, some of which are labeled in FIG. 3. Each wedge is assigned a particular number, ranging from one through twenty (although not all are shown on FIG. 3), which identifying indicia 205 are provided on annular ring 90, which is disposed outside of the playing surface of the dart board.

Figure 2:
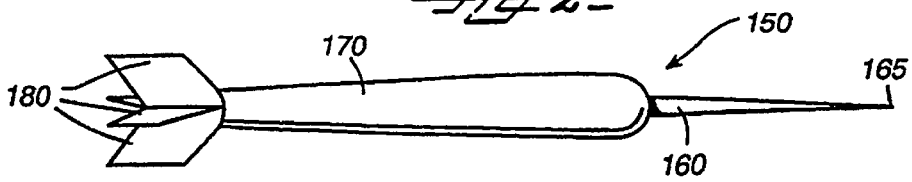
FIG. 2 is a side view of a standard dart.

Referring now to FIG. 2, there is shown a preferred dart for use with dart board 10 and generally indicated by reference numeral 150. Dart 150 comprises a tip 160, a body 170 and fins or flights 180. Tip 160 is sharpened to a point at end 165 and is generally made of steel or a durable polymer. In use, one holds dart 150 in a substantially horizontal direction with tip 160 pointing toward dart board 10. Dart 150 is then launched toward dart board 10 so that tip 165 partially penetrates the front surface of dart board 10. The dart may be launched through a tube or air gun towards the board, or it may be thrown. If the dart is launched through a tube or air gun, it may not be provided with fins. Furthermore, in the practice of the method in connection with a computerized simulated board and dart, the simulated dart will be launched electronically by the player towards the board.

In the sport of golf, each hole is assigned a reference number that corresponds to the number of golf club strokes required by a good golfer to get the ball into a cup in the green at the end of the fairway. An individual's score for each hole is computed based upon the number of actual strokes taken. The number of strokes required by a good golfer for each hole is referred to as par for that hole and is assigned by those laying out the course. In actual play, however, colloquial phrases are assigned to the difference between each particular score and par. For example, if a player hits the golf ball in the cup with one stroke while playing a hole having a par value of three, he scores a "hole in one" (value of minus two, or two under par). If the player requires two strokes to get the ball in the cup, he scores a "birdie" (minus one). A score of three strokes is deemed "par" (zero or "even"). A score of four strokes is referred to as a "bogey" (plus one). A score of five strokes is called a "double bogey" (plus two), while a score of six strokes is referred to as a "triple bogey" (plus three). If the hole is assigned a par of four or more, two under par is called an "eagle." The scores for each hole are tallied at the end of the first nine holes and again at the end of the second nine holes. The final score is computed by adding the score for the first nine holes to the score for holes ten through eighteen. The player with the lowest score is the winner.

The present invention is a method of playing a simulated golf game using darts and a dart board. This game can be played on a regulation dart board, as shown in FIG. 1, on a modified board, an example of which is shown in FIG. 3 or on a simulated, computer-generated dart board that may resemble the boards of FIGS. 1 and 3. The method of play comprises assigning to the different rings and the bullseye of the dart board scores that a player would receive when completing a hole in golf. Better scores are assigned to more difficult-to-hit zones on the board, and the scores that are assigned may depend on the skill level of the players. For example, when a "par three" hole is being played by an "amateur", bullseye 30 may take on a value of a hole in one, first ring 40 a birdie and second ring 50 a value of par. Similarly, third ring 60, fourth ring 70 and fifth ring 80 may be assigned a value of bogey, hitting the area surrounding the dart board may be assigned a score of double bogey, while hitting a wire (which causes the dart to fall to the floor) may be assigned a score of triple bogey. Additionally, the colors of the rings and wedges can be different in order to provide a greater visual impact. For example, a color pattern for a "pro" game may provide that second ring 50 of board 10 is green to signify the value of par, but for an "amateur" game's color pattern, both second ring 50 and fourth ring 70 may be painted green, thereby presenting a greater target for the participants and consequently a greater chance of scoring a value of par. Changing color patterns does not affect the overall configuration or arrangement of the zones, or necessarily the values assigned to them, but only provides a means for making a greater visual impact.

In a preferred embodiment of the invention, the method of play will first involve choosing a level of skill. The skill level varies in accordance with the experience of the players and is broken down into three categories; amateur, semi-professional and professional. Thereafter, the players choose a golf course that they wish the board to symbolize. At the chosen golf course, certain holes are par three holes. The players then designate the same "holes" on the dart board as par three. Par three holes are preferably played differently than the remaining holes, as will be explained below.

Referring now to FIG. 1, each hole of the course, one through eighteen, corresponds to the number assigned to the particular wedge 100 on the dart board 10. For example, if "hole four" is being played, each participant would aim his or her dart at wedge 100 corresponding to the number four.

When shooting a "hole" having a par value of four, the player must shoot at the particular wedge 100 which corresponds to the "hole" number. If the dart lands in that wedge, the preferred scoring scheme is as shown in Table 1.

TABLE 1

| Area: | Skill Level | | |
|---|---|---|---|
| | Amateur | Semi-Pro | Pro |
| Bullseye 30 | Bogey | Bogey | Bogey |
| First Ring 40 | Bogey | Bogey | Bogey |
| Second Ring 50 | Par | Par | Par |
| Third Ring 60 | Birdie | Birdie | Birdie |
| Fourth Ring 70 | Par | Par | Bogey |
| Fifth Ring 80 | Eagle | Eagle | Eagle |
| Outside Specified Wedge and Within Another Wedge | Bogey | Bogey | Bogey |
| Off of Dart Board | Double Bogey | Double Bogey | Double Bogey |
| Hitting a Wire and Falling to the Floor | Triple Bogey | Triple Bogey | Triple Bogey |

When a hole having a par three value is played, the preferred scoring changes, and the players at the semi-professional and professional level must shoot at bullseye 30 of board 10. When playing at the amateur level, the participants are given the option of shooting at bullseye 30 or playing the particular wedge 100. Preferably, this option will be elected prior to beginning the game. When shooting at bullseye 30, the particular wedge 100 corresponding to the hole and rings 40, 50, 60, 70 and 80 are disregarded unless the player throwing is an amateur and elects the wedge option as opposed to the bullseye option. The preferred scoring scheme for a par three hole in tabular form, is as shown in Table 2.

TABLE 2

| Area: | Skill level | | | |
|---|---|---|---|---|
| | Amateur/Wedge Option | Amateur/Bullseye Option | Semi-Pro | Pro |
| Bullseye 30 | Bogey | Hole-In-One (Eagle) | Birdie | Par |
| First Ring 40 | Bogey | Birdie | Par | Bogey |
| Second Ring 50 | Par | Par | Bogey | Double Bogey |
| Third Ring 60 | Birdie | Bogey | Bogey | Triple Bogey |
| Fourth Ring 70 | Par | Bogey | Double Bogey | Triple Bogey |
| Fifth Ring 80 | Hole-In-One (Eagle) | Bogey | Double Bogey | Triple Bogey |
| Outside Specified Wedge and Within Another Wedge | Bogey | — | — | — |
| Off of Dart Board | Double Bogey | Double Bogey | Triple Bogey | Triple Bogey |
| Hitting a Wire and Falling to Floor | Triple Bogey | Triple Bogey | Triple Bogey | Triple Bogey |

Every player throws one dart per hole. When all players have thrown eighteen darts, each person adds his or her scores from each hole to determine his or her final score. The player with the lowest final score is the winner.

An alternative scoring method requires that each person sum his or her individual scores from the first nine holes, i.e., the first nine throws, and then add (if over par) or subtract (if under par) that number to the total of the par values for the first nine holes to determine whether the person is shooting "even", "minus" or "plus". At the end of eighteen holes, each individual will add his or her scores for holes ten through eighteen and again add or subtract the total of the par values for holes ten through eighteen to that sum. The total for holes one through nine are combined with the total for holes ten through eighteen to give a score for the game.

In the event of a tie at the end of eighteen holes, the players having equal scores may continue to play hole nineteen (when playing using the preferred boards of FIGS. 1 and 3) and then, if necessary, hole twenty (corresponding to the wedge between wedges one and five). If they are still tied after twenty holes, they may then shoot for the bullseye to determine a winner. In such case, the player whose dart is closest to the bullseye is declared the winner.

To simulate different golf courses, dart board 10 can be rotated to alter the relative location of the various wedges 100. When using a standard dart board, wedge 100 having the number twenty assigned to it, is at the top or twelve o'clock position (between the wedges assigned the numbers five and one, as shown on FIG. 1). Rotation of the board will cause a shift in the spatial position of the wedges so that the wedge assigned the number twenty could be moved to the three o'clock position, for example. In the alternative, ring 90 of board 210 can be rotated to change the numbers assigned to each wedge 300, or if the board is computerized (not shown), the numbers or other indicia assigned to and displayed for each wedge-shaped zone may be changed. As a result, the players will have to adjust slightly, just as, in the game of golf, a player must alter his or her style of play to adapt to a particular golf course. Thus, an analogy can be created between the rotational position of the board or the ring and different golf courses. For example, the first position of the board can be viewed as playing on the famous Pebble Beach Golf Course. Rotating the board or ring to a second position may be viewed as playing on another famous golf course such as, for example, St. Andrews. A third rotation of the board or ring can be viewed as still another golf course, and so on. Using this analogy, it is possible to conduct a tournament, with each rotation of the board or ring signifying another course in the tournament. Alternatively, by using the actual par values of any particular golf course, the dart board can remain in one position while the par values assigned to the wedges can be altered to fit the particular golf course. Thus, players can "select" famous golf courses or regional favorites to "play" by changing the par value of each wedge, so that the par values for each wedge correspond to the course's par values.

In a preferred embodiment, the method of play according to the present invention is programmed into an electronic dart board. When so programmed, the electronic dart board will prompt the user to select a difficulty level and thereby adjust the level of play. Additionally, given special programming, the user will preferably be able to select a golf course on which to play, resulting in alteration in par value and sequence of play of the wedges. Furthermore, the electronic dart board will automatically keep score and provide a visual indication of the score, thereby simplifying the administrative aspects of the game.

It will be apparent that many changes and modifications can be made to the preferred embodiment described herein without departing from the spirit and scope of the invention. Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A method of playing a simulated golf game comprising:

a) providing a dart;

b) providing a dart board having a generally circular playing surface that is adapted to receive the dart, said surface having:

i) a plurality of wedge-shaped zones, each of which corresponds to a hole of a golf course;

ii) a plurality of annular rings; and iii) a generally circular bullseye located generally at the center thereof;

c) providing an identifying indicia for each wedge-shaped zone;

d) assigning a par value to each wedge-shaped zone;

e) assigning a score with respect to par value to the bullseye;

f) assigning a score with respect to par value to each annular ring;

g) assigning an ordered sequence for each wedge-shaped zone, so that each wedge-shaped zone may represent a hole of a simulated golf course, and so that the sequence may correspond to a sequence of holes on the simulated golf course representing a round of golf played on such course;

whereby each player may, in turn, launch the dart at the dart board for each hole of the simulated golf course and receive a score with respect to par for such hole; and whereby the cumulative total of each player's score is deemed to represent such player's score for a round of golf on the simulated golf course.

2. The method of claim 1, wherein at least eighteen wedge-shaped zones are provided, and the identifying indicia comprise sequential numbers beginning with the number one and ending with the number representing the number of wedge-shaped zones on the board, said number indicia being arranged around the board in a non-sequential order.

3. The method of claim 1, wherein a score with respect to par is assigned for the bullseye and each ring, so that each player may obtain a score for each hole selected from the group consisting of: triple bogey, double bogey, bogey, par, birdie and eagle.

4. The method of claim 1, wherein the identifying indicia for each wedge-shaped zone may be changed so as to change the ordered sequence in which the wedge-shaped zones are played.

5. The method of claim 1, which includes providing said dart having a central body with a tip at one end and a plurality of fins at the other end, and wherein the playing surface of the dart board is adapted to received the tip of the dart.

6. The method of claim 1, wherein the identifying indicia for each wedge-shaped zone is provided on an annular ring that is disposed outside of the playing surface of the dart board.

7. The method of claim 6, wherein the annular ring on which the identifying indicia are provided may be rotated so as to change the identifying indicia assigned to each wedge-shaped zone and thereby change the ordered sequence in which the wedge-shaped zones are played.

8. An improved game apparatus for use in connection with a simulated golf game, said apparatus including:

a) a dart having a body with a tip at one end; and b) a dart board having a generally circular playing surface that is adapted to receive the tip of a dart, said surface having;

i) at least eighteen wedge-shaped zones;

ii) a plurality of annular rings; and iii) a generally circular bullseye located generally at the center thereof;

c) said board being adapted for use in connection with a simulated golf game by assigning:

i) a par value to each wedge-shaped zone; and ii) a score with respect to par value to the bullseye; and iii) a score with respect to par value to each annular ring; and iv) an ordered sequence for the wedge-shaped zones; so that each wedge-shaped zone may represent a hole of a simulated golf course and the sequence assigned for the wedge-shaped zones may correspond to an ordered sequence of holes on the simulated golf course representing a round of golf played on such course;

d) wherein the improvement comprises an annular ring that is disposed outside of the playing surface o the dart board, which annular ring:

i) is provided with a plurality of different identifying indicia that are spaced so that an indicia is provided for each wedge-shaped zone; and ii) may be rotated with respect to the dart board so as to change the indicia assigned to each wedge-shaped zone;

whereby said indicia may be used to identify the sequence of holes on the simulated golf course for a round of simulated golf, and whereby the ring may be rotated with respect to the dart board to change the sequence of holes.

9. The improved game apparatus of claim 8, wherein the playing surface of the dart board has eighteen wedge-shaped zones.

10. The improved game apparatus of claim 8, wherein the identifying indicia comprise sequential numbers beginning with the number one and ending with the number representing the number of wedge-shaped zones on the board.

11. The improved game apparatus of claim 10, wherein the identifying numbers on the annular ring are arranged around the ring in a non-sequential order.

* * * * *